US006149338A

United States Patent [19]

Anderson

[11] Patent Number: 6,149,338

[45] **Date of Patent: *Nov. 21, 2000**

[54] HIGHWAY BARRIER

[76] Inventor: John Derrick Anderson, P.O. Box 2067, Mesquite, Nev. 89024

[ * ] Notice: This patent issued on a continued prosecution application filed under 37 CFR 1.53(d), and is subject to the twenty year patent term provisions of 35 U.S.C. 154(a)(2).

[21] Appl. No.: 09/119,333

[22] Filed: Jul. 20, 1998

[51] Int. Cl.[7] ..... E01F 13/00

[52] U.S. Cl. ..... 404/6; 404/9; 256/1; 256/13.1

[58] Field of Search ..... 404/6, 9; 256/13.1, 256/1; D10/109

[56] References Cited

U.S. PATENT DOCUMENTS

| | | | |
|---|---|---|---|
| 2,031,249 | 2/1936 | Bowman | 404/31 |
| 4,175,639 | 11/1979 | Wirt | 256/13.1 |
| 4,214,411 | 7/1980 | Pickett | 256/13.1 |
| 4,249,832 | 2/1981 | Schmanski | 404/6 |
| 4,338,041 | 7/1982 | Schmanski | 404/9 |
| 4,496,264 | 1/1985 | Casey | 404/6 |
| 4,751,893 | 6/1988 | Brantley | 256/13.1 |
| 4,899,498 | 2/1990 | Grieb | 52/144 |
| 4,964,750 | 10/1990 | House et al. | 404/6 |
| 5,015,119 | 5/1991 | Schmanski | 404/12 |
| 5,022,781 | 6/1991 | Smith | 404/6 |
| 5,039,250 | 8/1991 | Janz | 405/15 |
| 5,054,954 | 10/1991 | Cobb et al. | 404/6 |
| 5,181,695 | 1/1993 | Arthur | 256/13.1 |
| 5,190,394 | 3/1993 | Mallon et al. | 404/6 |
| 5,308,669 | 5/1994 | Prucher | 428/72 |
| 5,469,932 | 11/1995 | McNair | 181/210 |
| 5,487,619 | 1/1996 | Winebrenner | 404/6 |
| 5,492,438 | 2/1996 | Hilfiker | 405/285 |
| 5,494,371 | 2/1996 | Oberth et al. | 404/6 |
| 5,539,163 | 7/1996 | Anderson et al. | 181/210 |
| 5,577,861 | 11/1996 | Oberth et al. | 404/6 |
| 5,641,241 | 6/1997 | Rushing | 404/6 |

FOREIGN PATENT DOCUMENTS

| | | | |
|---|---|---|---|
| 0280609 | 8/1988 | European Pat. Off. | 256/13.1 |
| 2540533 | 8/1984 | France | 256/13.1 |
| 2546932 | 12/1984 | France | 256/13.1 |
| 2560243 | 8/1985 | France | 256/13.1 |
| 1409900 | 10/1968 | Germany | 256/13.1 |
| 1941602 | 2/1971 | Germany | 256/13.1 |
| 2821349 | 11/1979 | Germany | 256/13.1 |
| 717734 | 10/1966 | Italy | 256/13.1 |

*Primary Examiner*—Thomas B. Will
*Assistant Examiner*—Kristine M. Markovich
*Attorney, Agent, or Firm*—Knobbe, Martens, Olson & Bear, LLP.

[57] ABSTRACT

A visual barrier for highway use, comprising a horizontal web having a width and a length, wherein the length is greater than the width; and an undulating vertical web orthogonally connected to and extending away from the horizontal web, wherein the vertical web is formed of a thermoplastic material, and in which the horizontal web may be undulating, with first surfaces having holes therethrough and second surfaces without holes, wherein the second surfaces are facing toward oncoming traffic and the first surfaces and the holes are facing away from oncoming traffic.

18 Claims, 10 Drawing Sheets

HIGHWAY BARRIER

BACKGROUND OF THE INVENTION

The present invention relates to visual barriers for placement atop concrete highway barricades, and more particularly visual barriers formed of a thermoplastic material.

Concrete highway barricades have come into widespread use in the United States and in may other countries. These concrete highway barricades are typically either poured, one-piece construction, or are formed in moveable lengths. In either event, the barricades are typically from 2.5 to 3.5 feet in height, and have a wider base portion, tapering up to a narrower top portion. The taper of the concrete barricade is typically such that, upon impact from a vehicle, the vehicle is diverted back into its own lane of traffic, and does not cross the barricade to enter oncoming traffic.

Another advantage of the concrete highway barricades is that they permit opposing lanes of traffic to travel in close proximity to each other without substantial danger of a head-on collision. However, because the opposing lanes of traffic are close together, the oncoming traffic creates a distraction for the driver during daylight hours and an actual safety hazard at night, when the headlights of oncoming cars can shine into the driver's eyes.

To address this visual concern, various types of visual barriers have been proposed and actually used on top of the concrete barricades. One common type of visual barrier is a plywood panel or panel made of other wood products. Wood panels have a relatively short life in highway use, where precipitation, hydrocarbons, vehicle combustion products, pollution, sunlight, and water splashed from the road's surface tend to accelerate the weathering and aging process. Furthermore, weathered wood panels are not aesthetically pleasing, and are difficult to anchor to concrete surfaces in a rigid manner.

SUMMARY OF THE INVENTION

The present invention includes, in one aspect, a visual barrier for highway use, comprising a horizontal web having a width and a length, wherein the length is greater than the width; and an undulating vertical web orthogonally connected to and extending away from the horizontal web, wherein the vertical web is formed of a thermoplastic material. According to one aspect of the invention, there is an elongate concrete barricade having a top and a bottom surface, wherein the bottom is wider than the top, and wherein the horizontal web is affixed to the top of the barricade. Preferably, the vertical web has a series of vertically-oriented surfaces in a repeating pattern, wherein a first group of the surfaces faces generally in a first direction and a second group of the surfaces faces generally in a second direction, wherein the first surfaces have a plurality of holes extending therethrough in sufficient quantity and dimension to facilitate passage of wind through the barrier. Preferably, the second surfaces do not have the plurality of holes therethrough.

In one particularly preferred version of the invention, the holes in the barrier are oriented so that headlights of a vehicle do not substantially shine through the holes when the vehicle is passing the barrier with the barrier on the left side of the vehicle, but where the headlights would shine through the holes when the vehicle is passing the barrier with the barrier on the right side of the vehicle.

In various alternatives, the undulations of the vertical web define a serpentine shape, a rectangular shape, or a zigzag pleated shape. A top web can optionally be provided, extending along a top side of the vertical web and situated orthogonal to the vertical web.

In one preferred embodiment, the horizontal web and the vertical web are both formed from a single web of thermoplastic material. The horizontal web, or flange, can be formed by folding thermoplastic material in only one direction away from the vertical web, so that the horizontal web is located on one side of the barrier. Alternatively, the horizontal web is formed by folding individual sections of thermoplastic material in alternate directions away from the vertical web, so that the horizontal web is located on two sides of the barrier.

One embodiment of the invention has one side of each of section of the barrier joined to the vertical web by folding and another side of each of the sections is joined to a separate part of the vertical web by welding or adhesive bonding. A plurality of spaced fastener holes for joining the barrier to a concrete barricade can be provided.

Another embodiment of the invention comprises a barrier structure, having an elongated concrete barricade, wherein the top of the barricade is narrower than the bottom and the height is sufficient to substantially prevent vehicles from crossing over the barricade in accident situations; and a continuous visual barrier mounted on the top of the barricade, the visual barrier extending upward from the barricade to block vehicles on one side of the barrier from view of vehicles on an opposite side of the barrier, wherein the visual barrier comprises thermoplastic material, the visual barrier having a relatively wide bottom portion connected to the concrete barricade with a relatively thin vertical portion extending upwardly from the bottom portion. Optionally, the visual barrier comprises a plurality of thermoplastic panels having a height and a length, wherein the length is greater than the height, the panels being connected end-to-end along the top of the concrete barricade. Preferably, the panels are substantially completely formed of thermoplastic material.

In another variation of the invention, the visual barrier comprises a plurality of slotted posts connected to the top of the barricade, with a plurality of panels of thermoplastic material mounted in the slots and extending from post to post. Alternatively, the visual barrier comprises a plurality of thermoplastic panels having a length and a height, with a relatively thin interior portion and a relatively thick peripheral portion, wherein the length of the panel is greater than the height, and wherein the panels are connected together in an end-to-end relationship along the top of the barricade.

The present invention also includes a method for providing a visual barrier between lanes of oncoming traffic, wherein the lanes of traffic are separated by a concrete barricade having a top side, comprising the steps of: providing a plurality of thermoplastic panels having an undulating vertically-extending portion and a bottom flange, the panels having a height and a length, wherein the length is greater than the height; and connecting the flanges of the panels to the top of the concrete barricade with the panels in end-to-end relationship at a height that substantially blocks oncoming traffic from view of a driver on one side of the panels. Preferably the panels have a first group of surfaces generally facing in a first horizontal direction and a second group of surfaces generally facing in a second horizontal direction, wherein the panels have holes of sufficient size to provide a view through the panels in the first group of surfaces but not in the second group, and the method further comprises the step of orienting the panels so that substantially only the second surfaces are visible to oncoming traffic.

DETAILED DESCRIPTION OF THE INVENTION

A significant feature of the present invention is the use of thermoplastic materials to form visual barriers to be mounted atop concrete highway barricades. These thermoplastic materials can be formed in a number of different geometries. Various embodiments of the invention will be described below in more detail. It will, of course, be appreciated that the particular geometries that can be applied to thermoplastic materials for barricade use are almost limitless. Thus, although such designs are considered, in general, to be equivalent, it is impossible to recite every possible variation. Thus, one should appreciate that the designs disclosed herein are exemplary in nature, and not necessarily limiting.

Figure 1:
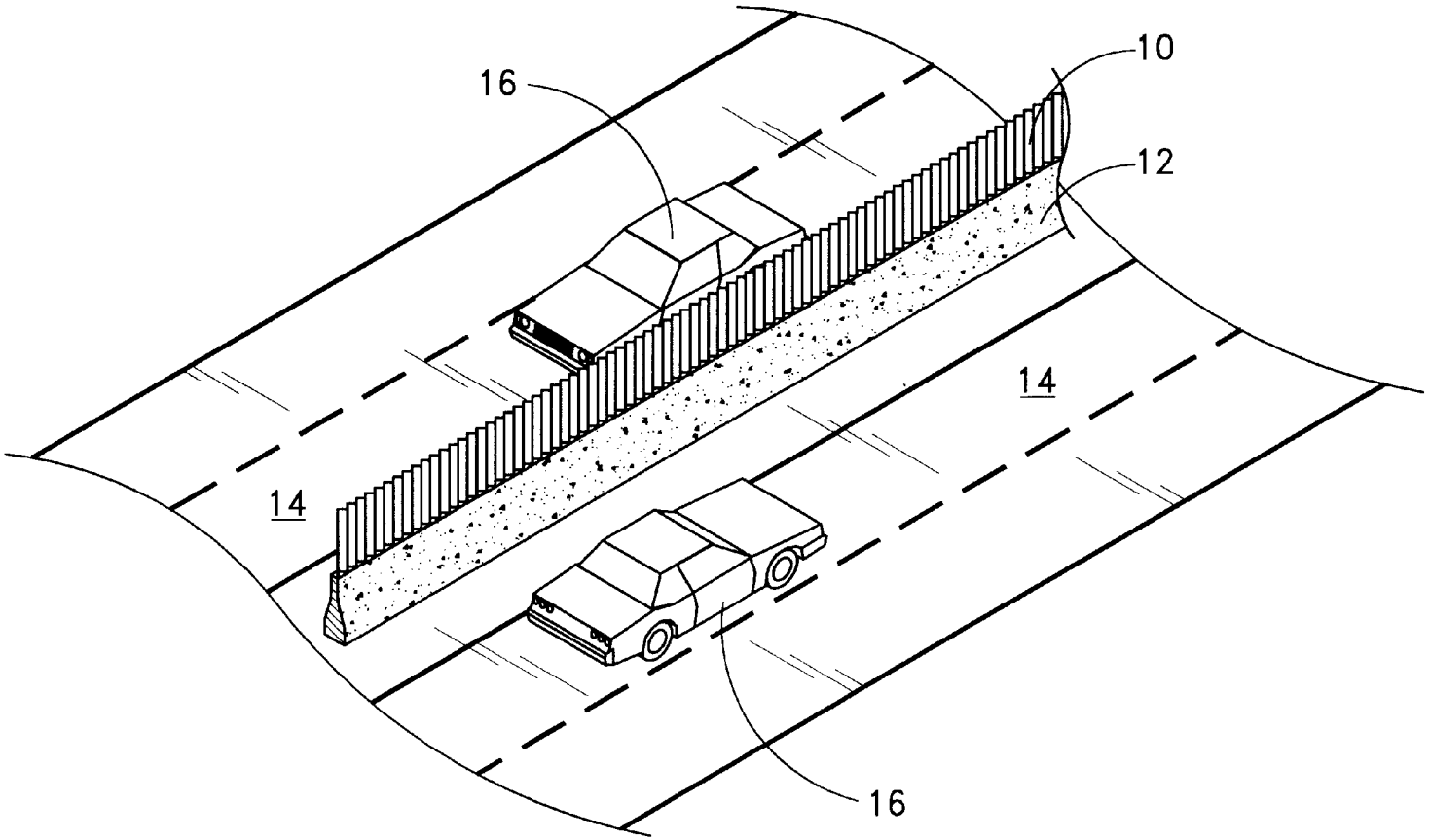
FIG. 1 is an elevated perspective view of the visual barrier of the present invention, in place atop a concrete barricade.

With reference to FIG. 1, a visual barrier 10 is provided atop a concrete barricade 12 located along a highway 14. Vehicles 16 move along the highway 14 in opposite directions on opposite sides of the barricade 12. The height of the concrete barricade 12 is typically between 2.5 and 3.5 feet. Thus, it is not of sufficient height to prevent drivers of vehicles 16 from seeing oncoming traffic. The visual barrier 10, however, extends up from the barricade 12 a sufficient distance (e.g., 1, 2, 2.5, 3, 3.5, or 4, 6, or 8 feet or more) in order to visually block the view of vehicles 16 moving in one direction from oncoming vehicles 16 moving in the opposite direction on the opposite side of the barricade 12. The visual barrier 10 and the concrete barricade 12 together comprise a barrier structure.

Figure 2:
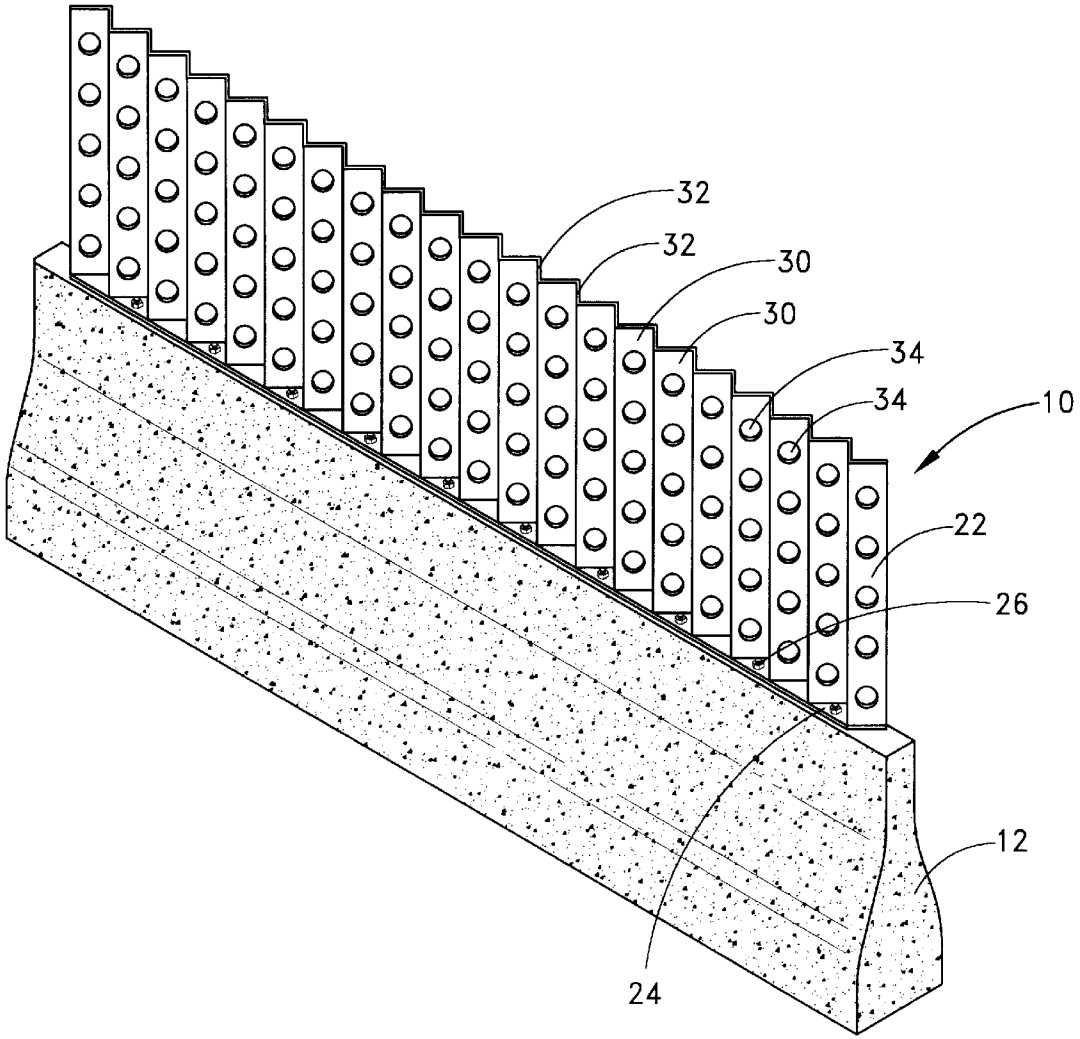
FIG. 2 is a perspective view of an accordion-pleat barrier of the present invention, affixed to a concrete barricade.

In one preferred embodiment of the invention, illustrated in FIG. 2, the visual barrier 10 includes a vertical web 22 and a horizontal flange 24. (The term "web" is used to refer to a sheet of material.) The horizontal flange 24 is located at the bottom of the vertical web 22 and serves to connect the visual barrier 10 to the concrete barricade 12 by means of fasteners 26. The fasteners 26 may be any suitable type of fasteners, such as screws, bolts, interlocking structures, powder actuated fasteners, adhesives, or expansion bolts or other expansion structures for mounting in holes (not shown) in the concrete barricade 12, and the like.

The vertical web 22 extends upwardly from the concrete barricade 12 and the horizontal flange 24. In a preferred embodiment, illustrated in FIG. 2, the vertical web includes a plurality of first surfaces 30 and second surfaces 32, facing generally in different horizontal directions. The first surfaces 30 may be provided with a plurality of holes 34. The holes 34 can serve to reduce wind pressure by permitting at least some of the wind to pass through the panel. This, in turn, reduces the required structural characteristics of the panel or barrier 10 and reduces the overall cost of the barrier 10. In the illustrated embodiment in FIG. 2, the first surfaces 30 and second surfaces 32 are relatively flat and are arranged as vertical pleats in an undulating, zigzag pattern. The vertical web 22 is joined at its bottom edge to the horizontal flange 24 by suitable connection techniques, including welding; e.g., ultrasonic welding, RF welding, heat welding, continuous feed welding, and the like; by gluing; or by forming the horizontal flange 24 integrally with the vertical web 22.

Figure 3:
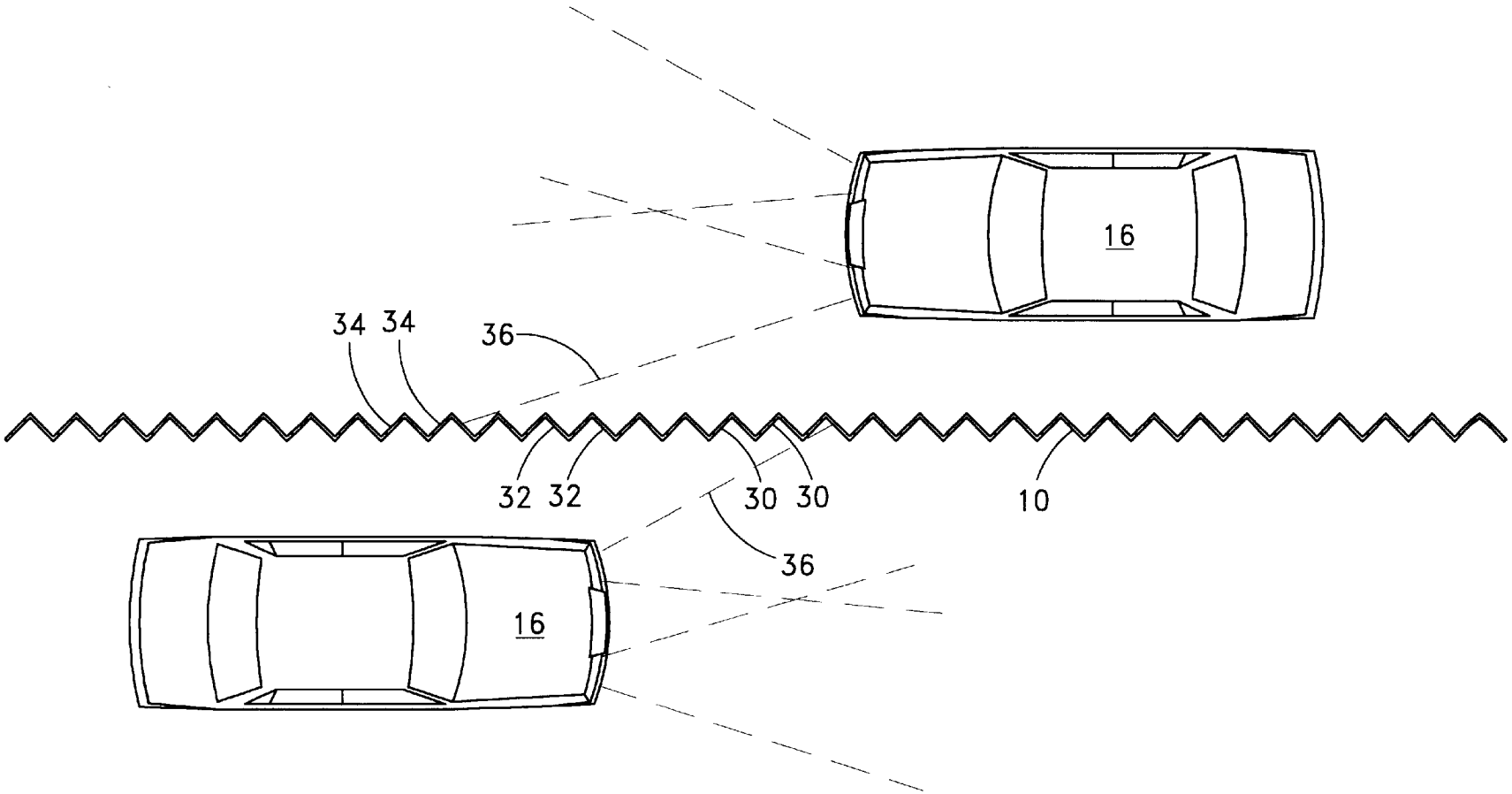
FIG. 3 is a plan view of a perforated barrier of the present invention, visually separating opposing lanes of traffic.

When an undulating vertical web 22 is used in the visual barrier 10, the holes 34 can advantageously be arranged to prevent the highlights from passing vehicles from shining through the visual barrier 10 and the holes 34 into oncoming traffic. Thus, as illustrated in FIG. 3, each vehicle 16 is in a traffic lane such that as it passes the visual barrier 10, the visual barrier 10 is on the left hand side of the vehicle 16. In FIG. 3, the vehicle 16 in the upper part of the Figure is moving to the left, and the vehicle 16 in the lower part of FIG. 3 is moving to the right. Note that, from the perspective of both vehicles 16, even though they are traveling in opposite directions, the barrier 10 is to the left of the each driver of a vehicle 16. Note that the first surfaces 30 of the visual barrier 10 are facing away from each driver of a vehicle 16, and that the second surfaces 32 of the visual barrier 10 are facing toward each driver of a vehicle 16.

The light pattern of the headlights of the vehicles 16 in FIG. 3 is illustrated by dotted lines 36. Note that when visual barrier 10 is oriented as shown in FIG. 3, with holes extending only through the first surfaces 30 of the pleats of the visual barrier 10, the headlight pattern 36 of each vehicle 16 impinges only against the second surfaces 32 of the visual barrier 10, and does not impinge on the first surfaces 30, nor pass through the holes 34. Thus, the holes 34 are configured such that they are not substantially visible to either vehicle, and the headlight pattern 36 does not pass through the holes 34 and blind the driver of a vehicle 16.

It should be noted that FIG. 3 is oriented in a preferred manner for those countries in which vehicles drive on the right-hand side of the road. In countries in which vehicles are driven on the left-hand side of the road, the orientation of the first surfaces 30, with holes 34, and the second surfaces 32 would be reversed, to provide the same headlight-blocking effect.

It should be further noted that, while the holes 34 are illustrated as circular holes of approximately 3, 4, 6, 10 or 12 inches in diameter, holes of other geometries and other dimensions can be substituted, and the holes can optionally be located in any desired portion of the barrier 10. Thus, a fine screen-like or mesh-like pattern of holes 34, can be provided, and the size of the holes 34 can range upward from less than one inch to well over one foot in one or more dimensions. Solid barriers 10 with no holes are also contemplated.

Figure 4:
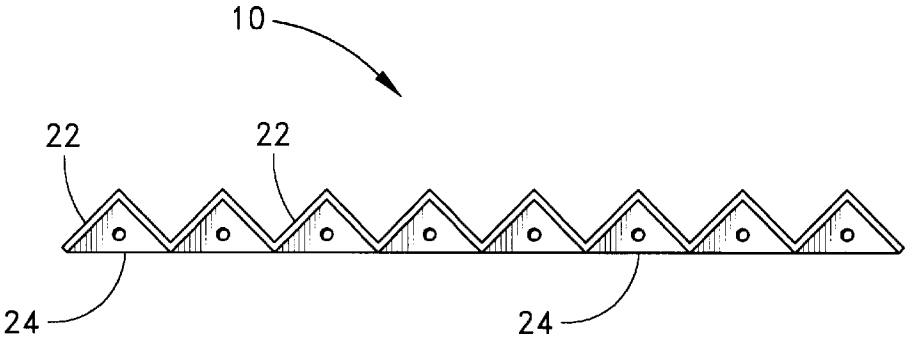
FIG. 4 is a plan view of one flange design for the barrier panels of the present invention.

With reference to FIG. 4, one preferred embodiment of the visual barrier 10 comprises a structure made entirely or at least substantially entirely out of thermoplastic, material. Suitable materials include polypropylene, polyethylene terephthalate, polystyrene, polyvinylchloride, polyethylene, (any of which can be high density, low density, and/or oriented materials), and any other relatively rigid, structurally sound thermoplastic material. Composite materials, including fiber-filled polymers, are also contemplated. The thermoplastic materials may be injection molded into a mold of any suitable pattern and dimension to create the visual barriers 10 of the present invention. Alternatively, in one particularly preferred embodiment, the visual barriers 10 are formed of sheet stock comprising rolls or sheets of thermoplastic material. The sheet stock may be vacuum molded or molded or formed in any other suitable way to form the desired visual barriers 10. In one particular embodiment of the invention, the visual barrier 10 is formed from preexisting rolls or sheets of flat webs of the desired polymer. A sheet of this thermoplastic material is heated and situated in a suitable mold and is drawn by vacuum into the mold to form the various features of the vertical web. Both a batch-wise process and a continuous process are specifically contemplated. The horizontal flange can be formed integrally at the same time as a portion of the original flat web of thermoplastic material is folded up by the mold into the shape illustrated in FIG. 4. When vacuum molding the sheet stock as shown in FIG. 4, the flange 24 will be formed primarily, substantially, or entirely on one side of the vertical web 22.

Figure 5:
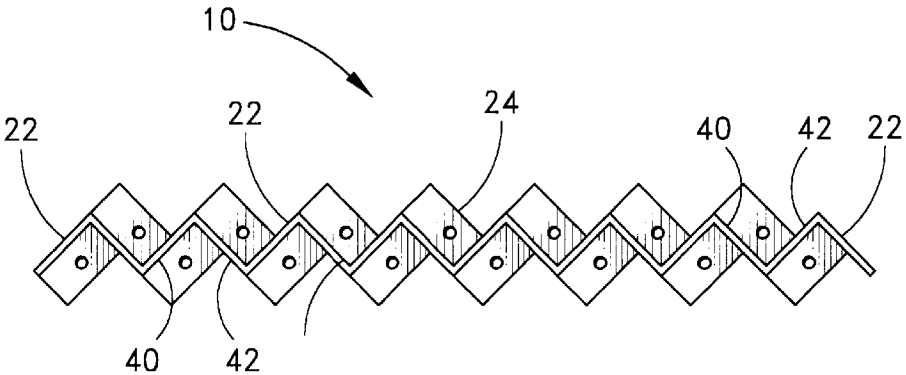
FIG. 5 is a plan view of an alternative flange design for the barrier panels of the present invention.

In an alternative embodiment, sheet stock is formed as illustrated in FIG. 5. The vertical web 22 is formed of the majority of the sheet stock or, in one embodiment, the entire width of sheet stock is formed into the undulating pattern of the vertical web 22. A portion of the vertical web is then sliced in the direction of the height of the vertical web, and folded over to form horizontal flanges 24. The horizontal flanges 24 illustrated in FIG. 5 comprise tabs having a width equivalent to each of the pleats of the vertical web 22, and are folded to alternating sides of the vertical web 22 at each pleat. A first edge 40 of each portion of the horizontal flange 24 is thus integrally joined to and folded from the vertical web 22. A second edge 42 of each such portion or tab comprising the horizontal flange 24 can then butt against an adjacent pleat of the vertical web 22. The second edge 42 of the flange 24 can be joined by any suitable technique to that adjacent pleat of the vertical web 22. Suitable methods include the various welding techniques previously discussed, solvent bonding, adhesives, or mechanical fasteners.

Figure 6:
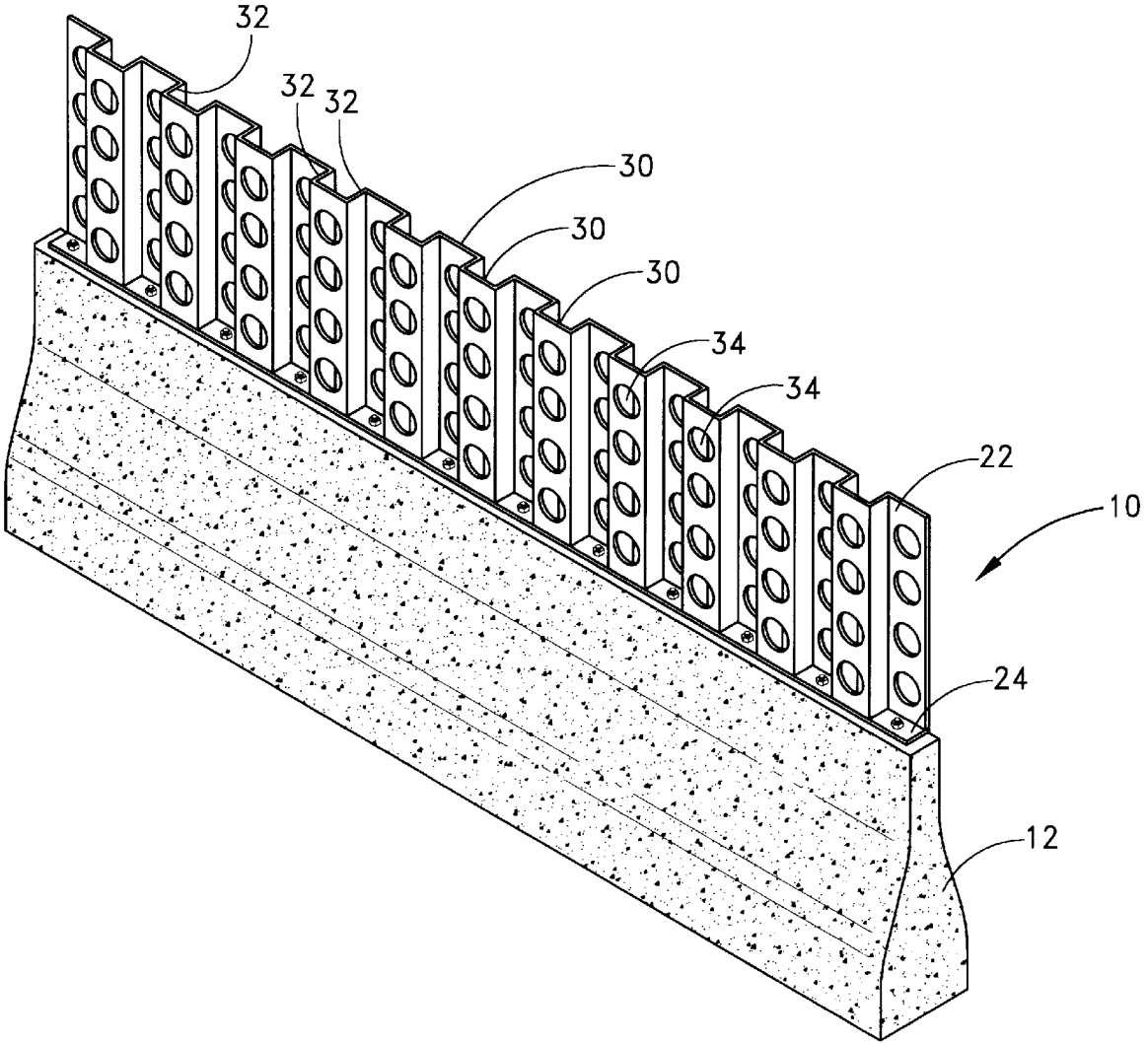
FIG. 6 is an elevated perspective view of rectangularly pleated version of the present invention, atop a concrete barricade.

FIG. 6 illustrates an alternative to the zigzag pleated design of the vertical web 22 illustrated in FIGS. 2–5. In FIG. 6, rather than utilizing a pleated design with pleats oriented at an angle to the length of the visual barrier 10, the vertical web is instead comprised of a plurality of surfaces that are oriented either parallel to or at right angles to the direction of travel of a vehicle passing the visual barrier 10 and with respect to the length of the visual barrier 10. Thus, using the same terminology as was used in connection with the zigzag undulating design, the vertical web 22 of the visual barrier 10 is comprised of a plurality of first surfaces 30 which are parallel to the length of the visual barrier 10. These vertically-extending first surfaces 30 are staggered along the length of the visual barrier 10 on alternating sides of the horizontal flange 24. Joining each of the alternating first surfaces 30 are a plurality of vertically-extending second surfaces 32 that each define a plane transverse to the length of the visual barrier 10. In a preferred embodiment, the first surfaces 30 are provided with holes 34 for the passage of wind pressure. Note that these holes 34, while permitting a driver of a vehicle 16 to look transversely through the visual barrier 10, nevertheless block a view of oncoming traffic and oncoming headlights at forward-looking angles of sight by cooperating with the transversely-extending second surfaces 32. Note further that, while the design of FIG. 6 uses additional plastic material in comparison to the design of FIG. 2, it is a universal design in that it will block the headlights and taillights of traffic of any orientation, whether the traffic drives on the right-hand side of the road or the left-hand side of the road.

Figure 7:
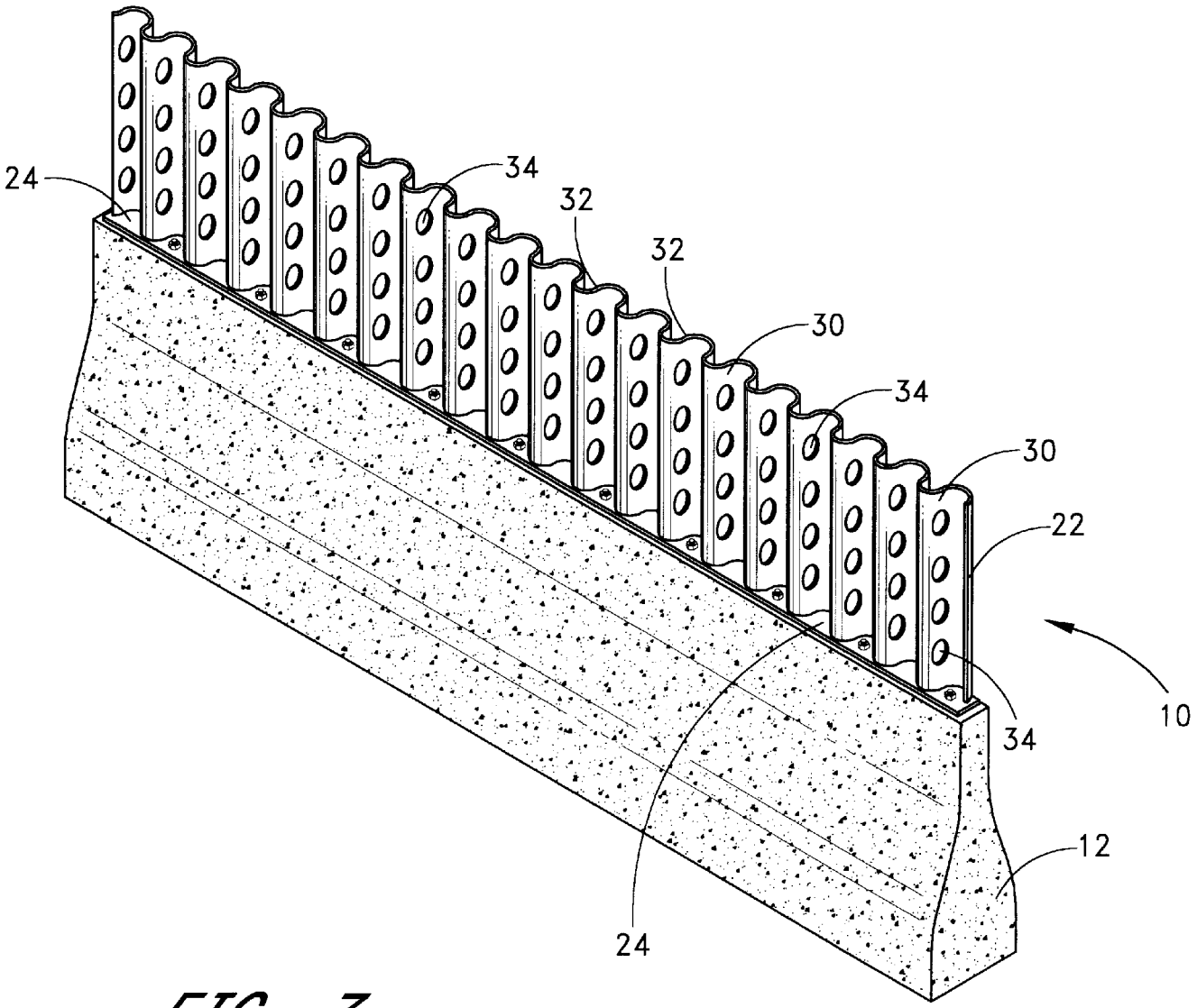
FIG. 7 is an elevated perspective view of a serpentine version of the present invention, atop a concrete barricade.

FIG. 7 illustrates yet another embodiment of the visual barrier 10 of the present invention. In this design, the undulating vertical web 22 has a serpentine configuration. Although a serpentine design as illustrated in FIG. 7 does not have exact boundaries between first surfaces 30 and second surfaces 32, there are, nevertheless, gently-curving first surfaces 30 that face, in general, away from a driver and gently-curving second surfaces 32 that face, in general, toward a driver. Holes 34 located in the first surfaces 30 will thus block oncoming headlights from blinding the driver of a vehicle 16 in a manner similar to the design illustrated in FIG. 3.

Figure 8:
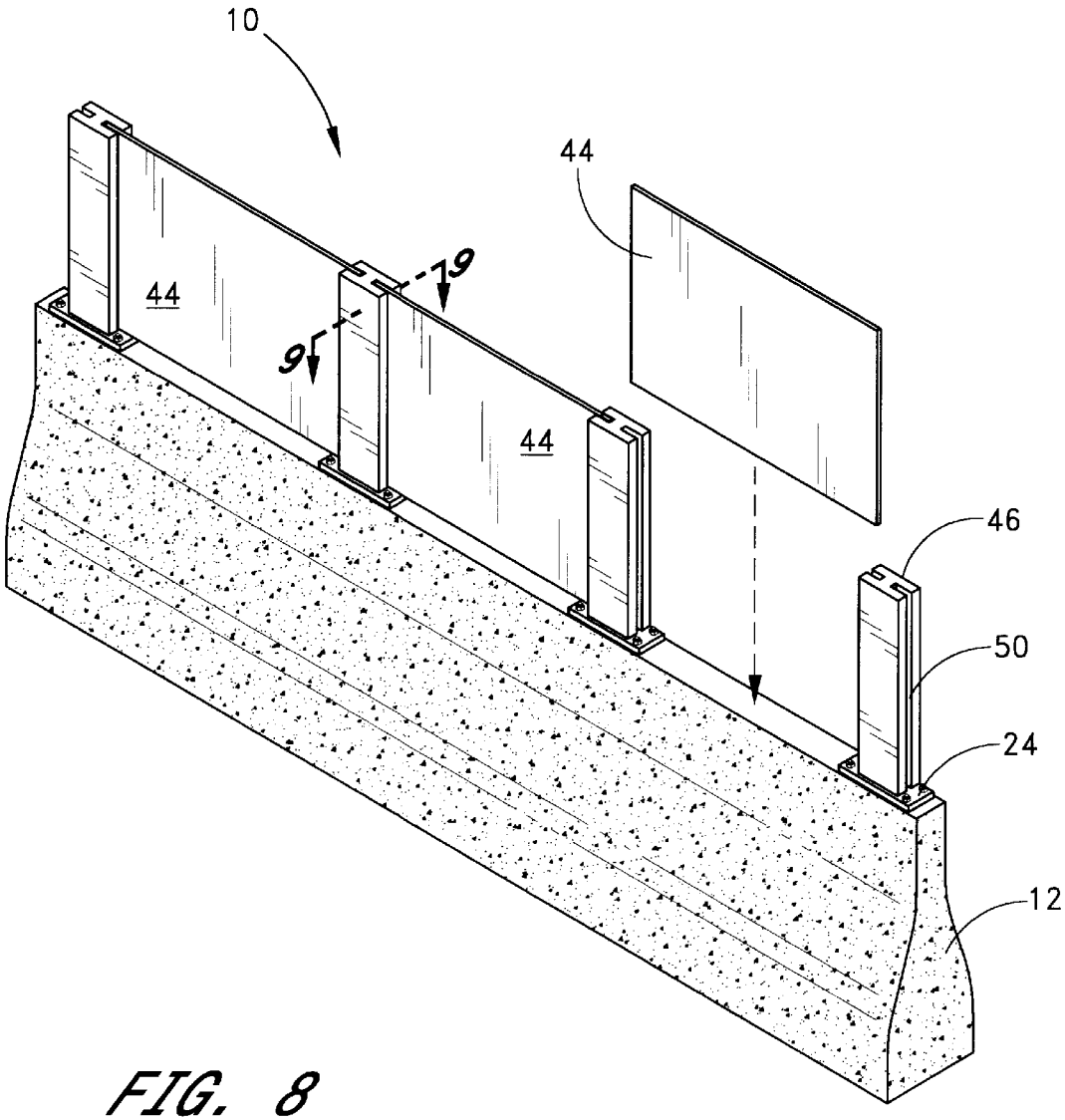
FIG. 8 is an elevated perspective view of a post-and-panel barrier of the present invention, atop a concrete barricade.
Figure 9:
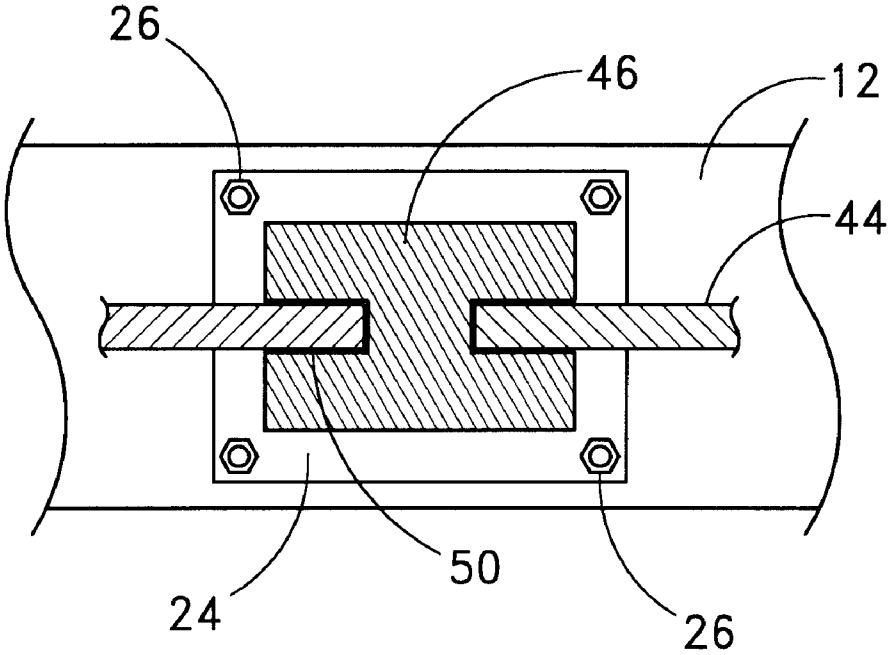
FIG. 9 is a horizontal cross-section taken along the line 9—9 in FIG. 8.

In addition to the undulating designs illustrated in FIGS. 1–7, the visual barrier 10 of the present invention may be formed of non-undulating panels 44, as illustrated (for example) in FIG. 8. With reference to FIG. 8, a plurality of vertical panels 44 made of thermoplastic material are inserted into a plurality of vertical posts 46 that are mounted by means of a horizontal flange 24 or other suitable mounting structure to a concrete barricade 12. In one embodiment, the vertical panels 44 slide into slots 50 in the vertical posts 46, as illustrated in more detail in FIG. 9. In the illustrated embodiment, the vertical panels 44 may be substantially planar, or they may include undulations or flanges to facilitate rigidity. The vertical posts 46 may be made of thermoplastic material, wood, steel, composites, or other suitable material.

Figure 10:
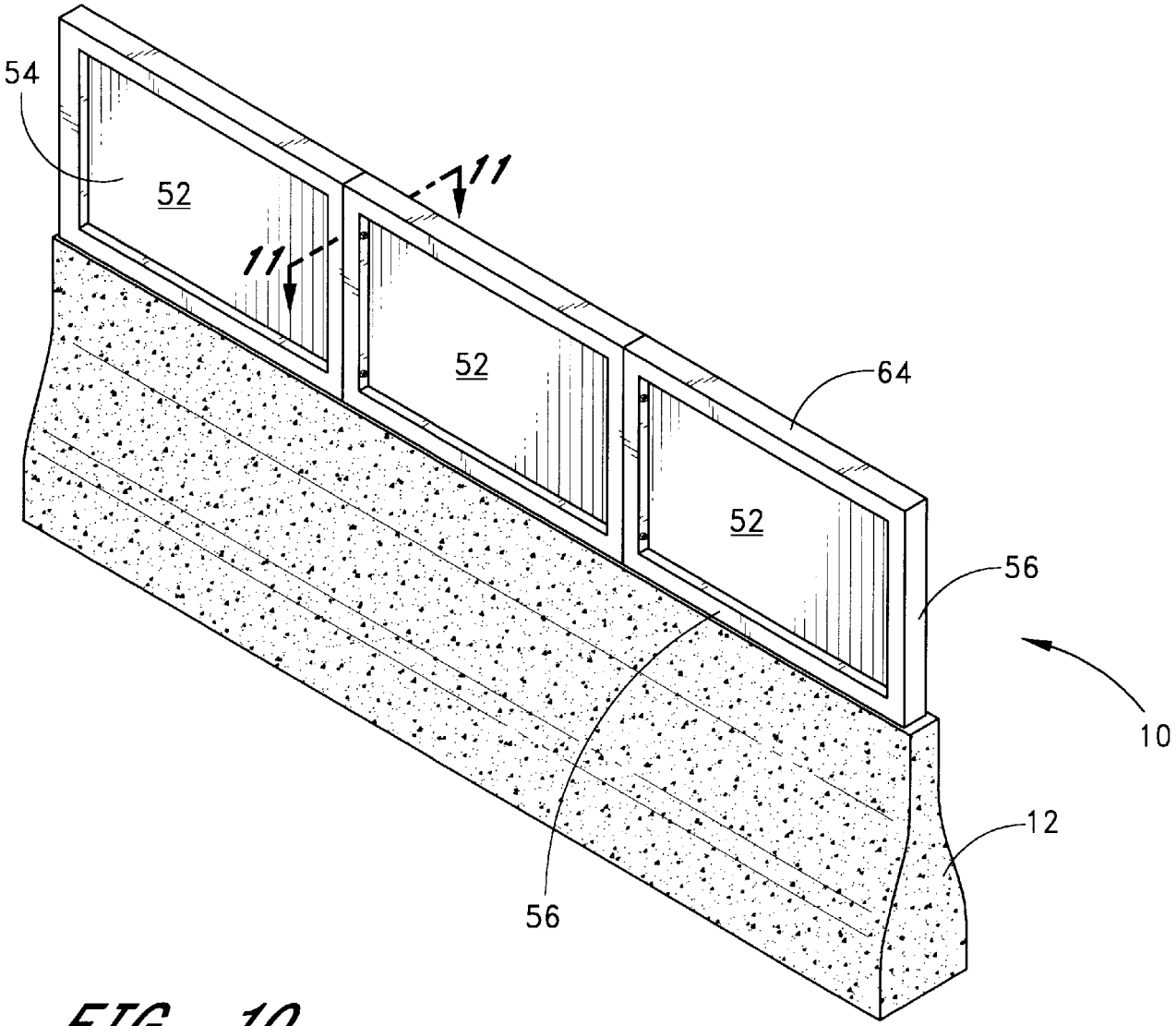
FIG. 10 is an elevated perspective view of an alternative panel version of the barrier of the present invention, atop a concrete barricade.
Figure 11:
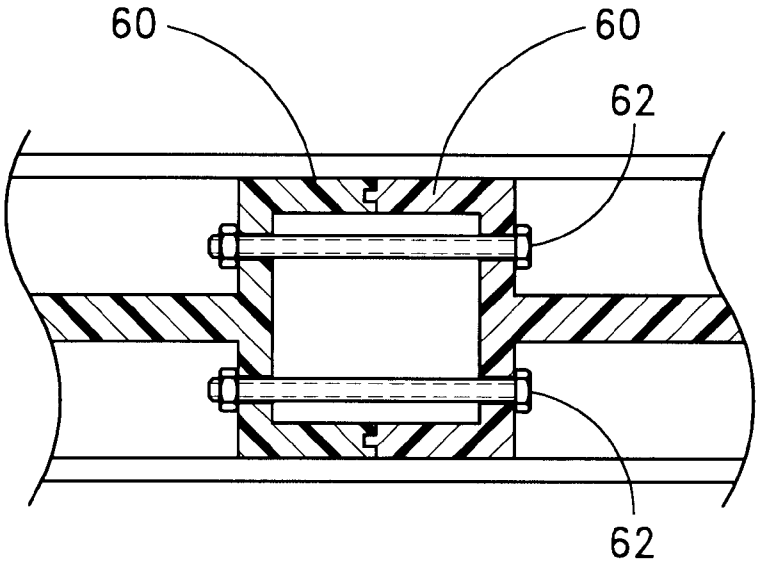
FIG. 11 is a horizontal cross-section taken along the line 11—11 in FIG. 10.

Yet another embodiment of the thermoplastic visual barrier 10 of the present invention is illustrated in FIG. 10. In this embodiment, a plurality of vertically-extending units 52 are provided. Each unit 52 comprises a relatively flat, planar inner section 54 bounded about at least three sides, and preferably about all four sides by a thicker reinforcing rib 56. The reinforcing rib 56 is fastened to the concrete barricade 12 by any conventional fastening system. In addition, as illustrated in more detail in FIG. 11, the reinforcing rib 56 can serve to connect individual units 52 together in end-to-end fashion extending along the length of the concrete barricade 12. Thus, the reinforcing rib, in the illustrated embodiment, can comprise a pair of channels 60 that extend vertically along each end of the unit 52. These channels 60 can then be mated together through use of through-bolts 62 or by any other suitable fastening means. In the embodiment illustrated in FIG. 11, the reinforcing ribs 56 and the channels 60 include tongue and groove mating surfaces extending vertically along the edges thereof for facilitating the joinder of the units 52 in end-to-end relationship. Of course, any number of other suitable joining techniques, such as dovetail joints, slot and groove, interlocking channels, and the like may alternatively be used. FIG. 10 further illustrates the use of a top web 64 which may comprise one of the reinforcing ribs 56 or which may be a simple flange or other similar structure to add additional rigidity to the units 52.

Similarly, a top web 64 (comparable to the horizontal flange 24) can be located along the top of any of the vertical webs 22 of any of the illustrated designs herein. For ease of assembly, and other substantial advantages, it is preferred that the vertical webs 22, the panels 44, and the units 52 of the various illustrated embodiments have a length that is greater than the height of those structures. In some embodiments of the invention, the panels or other types of visual barriers are constructed entirely of thermoplastic material. In other embodiments, metal reinforcing members, metal fasteners, or other non-thermoplastic materials may be added to reduce cost, facilitate rigidity, facilitate fastening, or provide other advantages. In those embodiments, however, the panels would still be considered to be formed substantially of thermoplastic material or substantially entirely of thermoplastic material, despite the small non-thermoplastic content.

Although the present invention has been described in the context of the illustrated preferred embodiments, it should be understood that those embodiments are not considered to be limiting. Rather, the scope of this patent should be determined by reference to the claims that follow and not limited to any of the particular preferred embodiments.

What is claimed is:

1. A visual barrier for highway use, comprising:

a horizontal web having a width and a length, wherein the length is greater than the width; and an undulating vertical web orthogonal to and extending away from the horizontal web; and wherein the horizontal web and the vertical web are integrally formed by folding a single web of thermoplastic material.

2. The barrier of claim 1, further comprising:

an elongate concrete barricade having a top and a bottom surface, wherein the bottom is wider than the top, and wherein said horizontal web is affixed to the top of said barricade.

3. The barrier of claim 1, wherein the vertical web has a series of vertically-oriented surfaces in a repeating pattern, wherein a first group of said surfaces faces generally in a first direction and a second group of said surfaces faces generally in a second direction, wherein said first surfaces have a plurality of holes extending there through in sufficient quantity and dimension to facilitate passage of wind through said barrier.

4. The barrier of claim 3, wherein said second surfaces do not have said plurality of holes therethrough.

5. The barrier of claim 4, wherein said holes are oriented so that headlights of a vehicle do not substantially shine through the holes when the vehicle is passing the barrier with the barrier on the left side of the vehicle, but where the headlights would shine through the holes when the vehicle is passing the barrier with the barrier on the right side of the vehicle.

6. The barrier of claim 1, wherein the undulations of said vertical web define a serpentine shape.

7. The barrier of claim 1, wherein the undulations of said vertical web define a zigzag pleated shape.

8. The barrier of claim 1, further comprising a top web extending along a top side of the vertical web and situated orthogonal to the vertical web.

9. The barrier of claim 1, wherein the horizontal web is formed by folding thermoplastic material in only one direction away from the vertical web, so that the horizontal web is located on one side of the barrier.

10. The barrier of claim 1, wherein the horizontal web is formed by folding individual sections of thermoplastic material in alternate directions away from the vertical web, so that the horizontal web is located on two sides of the barrier.

11. The barrier of claim 10, wherein one side of each of said sections is joined to said vertical web by folding and another side of each of said sections is joined to a separate part of said vertical web by welding or adhesive bonding.

12. The barrier of claim 1, wherein said horizontal web includes a plurality of spaced fastener holes for joining the barrier to a concrete barricade.

13. A barrier structure, comprising:

an elongated concrete barricade having a top and a bottom and a height, wherein the top is narrower than the bottom and the height is sufficient to substantially prevent vehicles from crossing over the barricade in accident situations; and a continuous visual barrier mounted on the top of said barricade, said visual barrier extending upward from said barricade to block vehicles on one side of the barrier from view of vehicles on an opposite side of the barrier, wherein said visual barrier comprises thermoplastic material, said visual barrier having a relatively flat, nonundulating bottom portion against said concrete barricade with an undulating vertical portion extending upwardly from said bottom portion, wherein said flat bottom portion and said undulating vertical portion are integrally formed solely by folding a single piece of said thermoplastic material.

14. The barrier structure of claim 13, wherein said visual barrier comprises a plurality of thermoplastic panels, wherein the panels are connected together in an end-to-end relationship along the top of said barricade.

15. The barrier structure of claim 13, wherein said visual barrier comprises a plurality of slotted posts connected to the top of said barricade, with a plurality of panels of thermoplastic material mounted in said slots and extending from post to post.

16. The barrier structure of claim 13, wherein said visual barrier comprises a plurality of thermoplastic panels having a length and a height, with a relatively thin interior portion and a relatively thick peripheral portion, wherein the length of the panel is greater than the height, and wherein the panels are connected together in an end-to-end relationship along the top of said barricade.

17. A method for providing a visual barrier between lanes of oncoming traffic, wherein the lanes of traffic are separated by a concrete barricade having a top side, comprising the steps of:

providing a plurality of thermoplastic panels having an undulating vertically-extending portion and a non-undulating continuous bottom flange, wherein the undulating vertical portion and the nonundulating bottom flange have been integrally formed from a single piece of thermoplastic material, and connecting the panels to the top of the concrete barricade with the panels in end-to-end relationship at a height that substantially blocks oncoming traffic from view of a driver on one side of the panels.

18. The method of claim 17, wherein said panels have a first group of surfaces generally facing in a first horizontal direction and a second group of surfaces generally facing in a second horizontal direction, wherein said panels have holes of sufficient size to provide a view through the panels in said first group of surfaces but not in said second group, further comprising the step of orienting said panels so that substantially only said second surfaces are visible to oncoming traffic.

* * * * *